US006082315A

United States Patent [19]

Schneider

[11] Patent Number: 6,082,315

[45] Date of Patent: Jul. 4, 2000

[54] ELECTROMAGNETIC VALVE ACTUATOR

[75] Inventor: Leo E. Schneider, Cypress, Calif.

[73] Assignee: Aura Systems, Inc., El Segundo, Calif.

[21] Appl. No.: 09/146,738

[22] Filed: Sep. 3, 1998

[51] Int. Cl.[7] ..... F01L 9/04

[52] U.S. Cl. ..... 123/90.11; 123/90.67; 123/188.13; 251/129.16; 73/119 R; 335/258

[58] Field of Search ..... 123/90.11, 90.65, 123/90.67, 188.13; 251/129.01, 129.05, 129.15, 129.16; 335/258, 262; 361/142; 73/117.3, 119 R

[56] References Cited

U.S. PATENT DOCUMENTS

| | | | |
|---|---|---|---|
| 2,863,432 | 12/1958 | O'Brien | 123/90.52 |
| 5,069,422 | 12/1991 | Kawamura | 251/129.1 |
| 5,596,956 | 1/1997 | Ogawa et al. | 123/90.11 |
| 5,769,043 | 6/1998 | Nitkiewicz | 123/90.11 |
| 5,785,016 | 7/1998 | Enderle et al. | 123/90.11 |
| 5,887,553 | 3/1999 | Ballmann et al. | 123/90.11 |

*Primary Examiner*—Wellun Lo
*Attorney, Agent, or Firm*—Blakely, Sokoloff, Taylor & Zafman LLP

[57] ABSTRACT

An electromagnetic valve actuator is disclosed. The actuator includes an upper electromagnet and a lower electromagnet placed in a mirror relationship to each other about a central vertical axis, an armature element disposed intermediate the upper and lower electromagnets, the armature element having a normally biased initial first position between the upper and lower electromagnets when the electromagnets are off, a second fixed open position proximal the lower electromagnet when the lower electromagnet is energized, and a third fixed closed position proximal the upper electromagnet when the upper electromagnet is energized, an armature shaft attached to the armature element and extending vertically through a channel in the lower electromagnet, an upper spring retainer assembled onto the armature shaft, an upper spring disposed between the lower electromagnet and the upper spring retainer, the upper spring biasing the armature element in the first position when the electromagnets are off and accelerating the armature element toward the lower electromagnet when the valve is opened, a valve stem in a collinear relationship to the armature shaft, a valve spring retainer assembled onto the valve stem, a valve spring disposed between the cylinder head and the valve spring retainer, the valve spring biasing the armature element in the first position when the electromagnets are off and accelerating the armature element toward the upper electromagnet when the valve is closed.

6 Claims, 6 Drawing Sheets

ELECTROMAGNETIC VALVE ACTUATOR

FIELD OF THE INVENTION

The present invention relates generally to electromagnetic valve actuators, and more particularly to a compact electromagnetic valve actuator having a position sensor incorporated into an inverted spring design.

BACKGROUND OF THE INVENTION

In an effort to optimize the operation of internal combustion engines, there have been numerous proposed improvements to cylinder valve designs. One approach has been to replace conventional valve assemblies with electromagnetically powered systems for moving engine valves. Electromagnetic valve actuators eliminate the need for the most complex and costly parts of the engine, namely the camshaft, drive gears, valvetrain components and emissions devices.

Referring to prior art FIG. 1, there is shown a known electromagnetic actuator 10. The actuator 10 includes two pairs of electromagnetic elements 12, a plurality of coils 14, a core 16, a support spring 20, a valve stem 22, and a valve case 24. Each of the electromagnetic elements 12 defines a central chamber 26. The central chamber 26 further defines a central vertical axis 28. Each pair of electromagnetic elements 12 further comprises an upper electromagnetic element 32 and a lower electromagnetic element 34. The upper and lower electromagnetic elements each include a central channel 30, in which the coils 14 are disposed. The upper and lower electromagnets 32, 34 are in a mirrored relationship to each other, with the central channels 30 of the upper and lower electromagnetic elements being in a facing relationship to each other.

Disposed intermediate the upper and lower electromagnetic elements 32, 34 is the armature element 16. The armature element 16 is interconnected to the valve stem 22. The valve stem 22 extends in axial alignment with the central vertical axis 28 of the central chamber 26 of the electromagnetic elements 12. A valve case 24 encloses the valve. The support spring 20 is disposed within the central chamber 26 surrounding the valve stem 22.

To close the valve, the upper electromagnet is energized, attracting the armature to the first electromagnet and compressing the upper spring. To open the valve, the energized first electromagnet is turned off and the second electromagnet is energized. Due to the force of the pre-stressed spring, the armature is accelerated toward the second electromagnet thereby reducing the amount of magnetic force required to attract the armature away from the upper electromagnet.

A problem with the use of electromagnetically actuated valves with modern internal combustion engines is that the design of engines only allows a specific area for the intake and exhaust valves. Because of the shape and height requirements of the known electromagnetic actuators, it is difficult to replace the camshaft-driven valves with electromagnetically actuated valves without requiring substantial modifications to some engine designs. Therefore, a need exists for an electromagnetic valve actuator assembly design that is compact and compatible with a modern automobile internal combustible engine, with minimal modifications to the engine design.

Another problem with prior electromagnetically actuated valves is in obtaining a zero gap at the upper electromagnet when the valve is properly seated. This problem is exacerbated by the thermal expansion of the engine and actuator materials that occurs during operation of the valve. The valve needs to be seated before the armature element reaches the upper electromagnet. Thermal expansion may prevent the armature from obtaining a zero or near zero gap. A zero or near zero gap is desired to maintain power consumption at a low level and failure to attain a near zero gap results in inefficient operation of the valve system. Therefore, it is desirable to have an electromagnetic actuator design that ensures that the armature element contacts the upper electromagnet after closure of the valve.

Another limitation of the previously designed valves is that the placement of the spring requires the existence of a central chamber. The upper and lower electromagnets each have a channel disposed therein to accommodate the support spring. The gap in the center of the electromagnet reduces the electromagnetic surface area available to attract the armature. Accordingly, it is desirable to have an electromagnetic actuator design that maximizes the electromagnetic surface area available for the actuation of the armature.

Another problem with the previously designed valves is that the moving armature element must return to an initial neutral position when not in operation. As previously described, it is known to use a spring to bias the armature element in this neutral position. However, spring tensions inevitably vary, which creates difficulty in obtaining a neutral position for the armature element that is biased between the upper and lower electromagnets. Therefore, it is desirable to have a means for manually adjusting the position of the armature element in order to achieve the desired biased position.

Another restriction of the prior valve design is that it limits the options available for the placement of a sensor. To derive the full benefit of the variable valve timing feature of electromagnetic valve actuators, the actuator is supplemented with a servo control system. The servo control system utilizes a sensor to track the position of the valve or armature at any given time. It is known to use sensors to detect the position of the valve. However, previous valve designs have been limited in the location available for the placement of the sensor. To measure the position of the armature, the sensor is usually placed between the upper and lower electromagnets. The placement of the sensor near the electromagnet, however, has several disadvantages. Most importantly, the magnetic field created by the electromagnets influences the accuracy of the sensor signal. Accordingly, it is desirable to have an electromagnetic actuator design that provides more alternatives for placement of the sensor.

SUMMARY OF THE INVENTION

Accordingly, it is a primary object of the present invention to overcome one or more disadvantages and limitations of the prior art.

A significant object of the present invention is to provide an electromagnetic actuator valve assembly design that would fit within a compact space having restrictive height and valve to valve spacing limitations.

Another object of the present invention is to provide an electromagnetic actuator valve assembly design that compensates for heat expansion during operation of the actuator and ensures a zero gap between the armature element and the upper electromagnet.

Yet another object of the present invention is to provide an electromagnetic actuator wherein the effective electromagnetic area available is increased.

Another object of the present invention is to provide an electromagnetic actuator valve assembly design with manual adjustment for obtaining precise mechanical tolerances.

Another object of the present invention is to provide an electromagnetic actuator design that provides more alternatives for placement of the sensor.

According to a broad aspect of the present invention, an electromagnetic actuator for an actuated valve comprises an upper electromagnet and a lower electromagnet placed in a mirror relationship to each other about a central vertical axis, an armature element disposed intermediate the upper and lower electromagnets, the armature element having a normally biased initial first position between the upper and lower electromagnets when the electromagnets are off, a second fixed open position proximal the lower electromagnet when the lower electromagnet is energized, and a third fixed closed position proximal the upper electromagnet when the upper electromagnet is energized, an armature shaft attached to the armature element and extending vertically through a channel in the lower electromagnet, an upper spring retainer assembled onto the armature shaft, an upper spring disposed between the lower electromagnet and the upper spring retainer, the upper spring biasing the armature element in the first position when the electromagnets are off and accelerating the armature element toward the lower electromagnet when the valve is opened, a valve stem in a collinear relationship to the armature shaft, a valve spring retainer assembled onto the valve stem, a valve spring disposed between the cylinder head and the valve spring retainer, the valve spring biasing the armature element in the first position when the electromagnets are off and accelerating the armature element toward the upper electromagnet when the valve is closed.

A feature of the present invention is that the inverted spring design reduces the height of the electromagnetic actuator by a distance equivalent to the sum of the length of the upper spring, the valve lift and the upper housing.

To further minimize the height of the actuator, the design can be modified such that the upper spring encompasses the entire valve spring retainer and part of the valve spring. To accomplish this design, the diameter of the upper spring is chosen such that it is greater than the diameter of the valve spring and the valve spring retainer. The valve spring retainer and the valve spring can then be fitted inside the upper spring. The height of the actuator is thereby further minimized in an amount equivalent to the portion of the valve spring encompassed by the upper spring.

Another feature of the present invention is that the actuator can compensate for any thermal expansion that occurs during the operation of the valve. In the event that the valve is seated before the armature element reaches the upper electromagnet, the armature shaft and the valve stem separate creating a clearance between the adjacent movable parts. This lash feature ensures a zero gap between the armature element and upper electromagnet when the valve is closed.

Yet another feature of the present invention is the increased efficiency of the system resulting from an increased electromagnetic surface area on the upper electromagnet. The present invention eliminates the need for an armature shaft extending through a channel in the upper electromagnet. The elimination of the armature shaft and bushing on the upper electromagnet allows for a continuous electromagnetic surface and effectively increases the useful surface of the upper electromagnet. Accordingly, the upper electromagnet provides more force and the increased force results in a more efficient actuation system.

Another feature of the present invention is that adjustment devices are used to preload the upper spring and valve spring, thus allowing the neutral position of the armature element to be set precisely.

Another feature of the present invention is that it provides more alternatives for placement of a valve or armature position sensor.

These and other objects, advantages and features of the present invention will become readily apparent to those skilled in the art from a study of the following description of an exemplary preferred embodiment when read in conjunction with the attached drawing and appended claims.

DESCRIPTION OF AN EXEMPLARY PREFERRED EMBODIMENT

Figure 2:
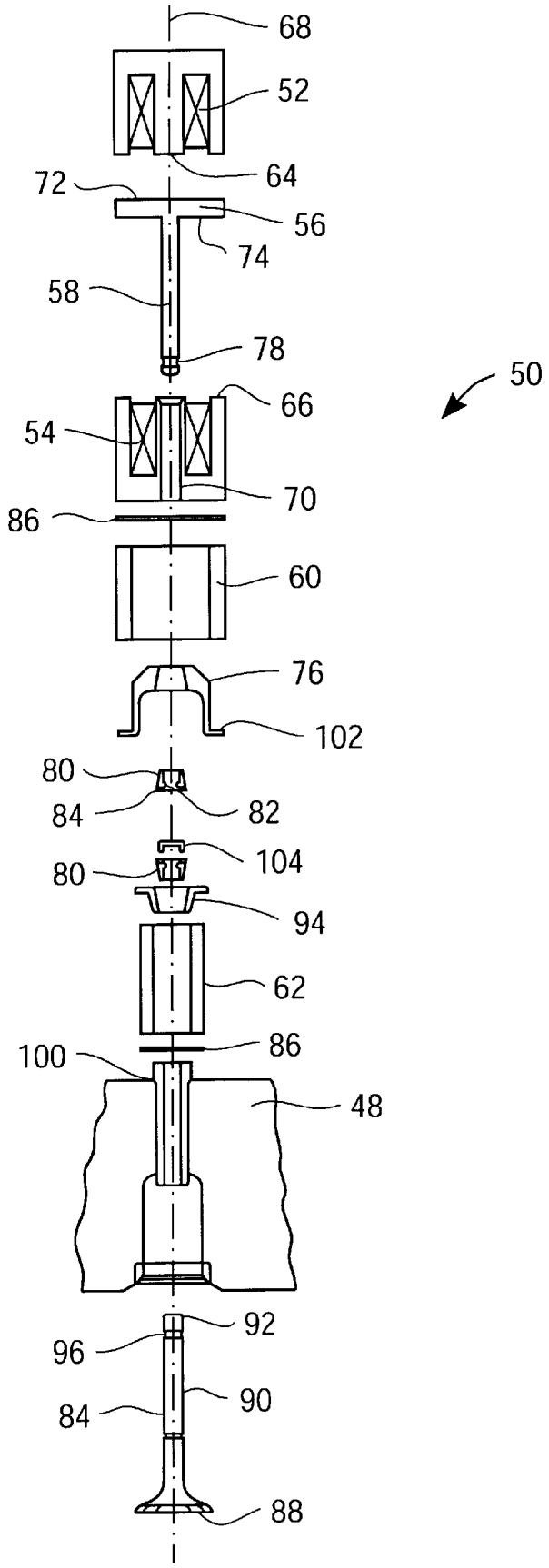
FIG. 2 is a exploded view of an electromagnetic valve actuator of the present invention.

Referring now to FIG. 2, an embodiment of an electromagnetically valve actuator 50 of the present invention is shown in cross-section. In the embodiment shown, the actuator 50 includes an upper electromagnet 52, a lower electromagnet 54, an armature element 56, an armature shaft 58, an upper spring 60, and a valve spring 62.

The upper and lower electromagnets 52, 54 have pole faces 64, 66, respectively. The pole faces 64, 66 of the upper and lower electromagnets 52, 54 are in a mirrored relationship to each other about a central vertical axis 68. The lower electromagnet 54 has a central channel 70 disposed in the pole face 66. The central channel 70 surrounds the central vertical axis 68.

Disposed intermediate the upper and lower electromagnets 52, 54 is the armature element 56. The armature element 56 provides an upper pole face 72 in a facing relationship to the pole face 64 of the upper electromagnet 52 and lower pole face 74 in a facing relationship to the pole face 66 of the lower electromagnet 54. The armature element 56 is initially biased in a neutral position when the upper and lower electromagnets are off. As the upper electromagnet is energized, the upper electromagnet attracts the armature element and the armature element begins to approach the upper electromagnet. When the armature element contacts the upper electromagnet, the valve attains a fully closed position. Conversely, if the upper is turned off and the lower electromagnet is energized, the armature element approaches the lower electromagnet. When the armature element contacts the lower electromagnet, the valve attains a fully open position.

Figure 3:
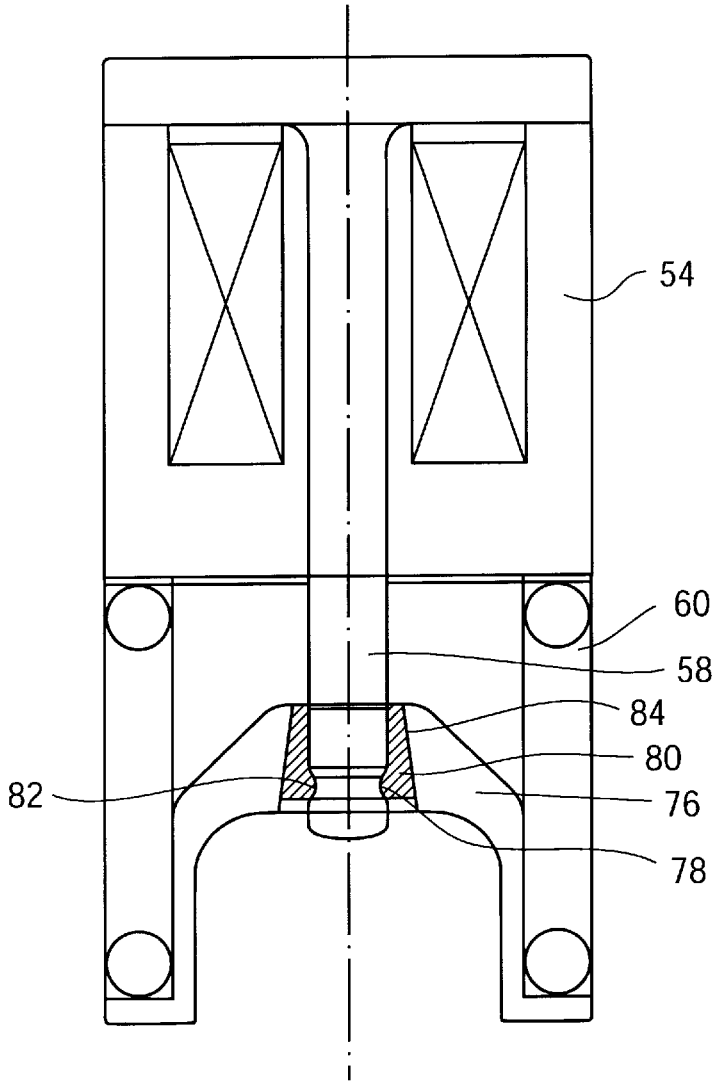
FIG. 3 is a cross-sectional view of the upper spring retainer assembled onto the armature shaft.

The armature element 56 is integrally attached to an armature shaft 58. The armature shaft 58 extends vertically through the central channel 70 of the lower electromagnet 54. An upper spring retainer 76 is assembled onto the armature shaft 58. In FIG. 3, the preferred embodiment of assembling the upper spring retainer 76 onto the armature shaft 58 is shown. The armature shaft defines a groove 78. Clips or keepers 80 are used to couple the upper spring retainer 76 to the armature shaft 58. Each keeper 80 includes a tab 82, which is dimensioned to be received within the groove of the armature shaft 58. The tapered surface 84 of the keeper 80 is dimensioned to be received by the upper spring retainer 76. When tab 82 is fitted into groove 78 of the armature shaft and upper spring retainer 76 is fitted against the tapered surface 84 of the keeper 80, the upper spring retainer 76 is secured onto the armature shaft 58. In the preferred embodiment of this invention, two keepers 80 are used for each spring retainer assembly.

The upper spring 60 is disposed intermediate the upper spring retainer 76 and the lower electromagnet 54. The upper spring 60 biases the armature element 56 in a neutral position when the electromagnets are off. When the upper electromagnet 52 is energized, the armature element 56 approaches the upper electromagnet 52 thereby compressing the upper spring 60. When the upper electromagnet is turned off, the prestressed upper spring 60 accelerates the armature element 56 toward the lower electromagnet 54 and the valve is opened.

During periods of inoperation, the upper spring 60 and valve spring 62 are used to bias armature element 56 between the upper and lower electromagnets 52, 54. It is difficult to obtain the precise neutral position desired because spring tensions inevitably vary. Accordingly, to adjust for irregularities in spring tension, the spring can be preloaded to counteract the effects of the variation in spring tension. Specifically, if the armature element is not at the neutrally biased position after the springs are installed, shims 86 can be placed between the upper spring and the lower electromagnet to preload the upper spring. Alternatively, shims can be placed between the upper spring and the upper spring retainer.

The upper spring 60 can also be preloaded without the use of shims. In this alternative, the extent of the spring preload is dependent on the location of the upper spring retainer relative to the spring contact on the electromagnet. For instance, if the upper spring retainer is assembled at a location closer to the electromagnet on the armature shaft, the spring is compressed further. The smaller the distance between the electromagnet and the upper spring retainer, the higher the preload of the upper spring.

A valve 86 is positioned in a collinear relationship to the armature shaft 58. The valve 86 includes a valve head 88 and a valve stem 90. A valve tip 92 is located at the end of the valve facing the armature shaft 58. A valve spring retainer 94 is assembled onto the valve stem 90. The valve spring retainer 94 can be assembled onto the valve stem 90 in the same manner that the upper spring retainer 76 is attached to the armature shaft 58. Namely, the valve stem 90 defines a groove 96. Clips or keepers 80 are used to couple the valve spring retainer 94 to the valve stem 90. Each keeper 80 includes a tab 82, which is dimensioned to be received within the groove 96 of the valve stem 90. The tapered surface 84 of the keeper 80 is dimensioned to be received by the valve spring retainer 94. When tab 82 is fitted into groove 96 of the valve stem 90 and valve spring retainer 96 is fitted against the tapered surface 84 of the keeper 80, the valve spring retainer 96 is secured onto the valve stem 90.

The valve 86 is mounted onto a cylinder head 98. The top surface of the cylinder head 98 defines a valve seat 100. The valve spring 62 is disposed intermediate the valve spring retainer 96 and the valve seat 100. As previously discussed, the upper spring 60 and valve spring 62 are used to bias armature element 56 when the electromagnets are not energized. To precisely adjust the location of the armature element 56, the valve spring 62 can be preloaded in a manner similar to the preloading of the upper spring 60. Namely, shims 86 can be placed between the valve spring 62 and the valve seat 100 to preload the valve spring. Alternatively, shims can be placed between the valve spring 62 and the valve spring retainer 94.

As with the upper spring, the valve spring 62 can also be preloaded without the use of shims. As discussed in relation to the upper spring, the extent of the spring preload is dependent on the location of the spring retainer. Accordingly, the valve spring 62 can be preloaded by adjusting the position of the valve spring retainer 94. If the valve spring retainer 94 is assembled at a lower location on the valve stem 90, the spring is compressed. The lower the location of the valve spring retainer, the higher the preload of the valve spring.

In the preferred embodiment of the present invention, the diameter of the upper spring 60 is greater than the diameter of the valve spring 62, such that the valve spring 62 and valve spring retainer 94 can fit inside the upper spring 60. To accommodate the placement of the valve spring 62 and the valve spring retainer 94 inside the upper spring 60, the upper spring retainer 76 is modified to have a dome-shaped cross-section and a lip 102 surrounding the circumference of the upper spring retainer 76. As best shown in FIG. 2, the upper spring 60 rests on the lip 102 of the upper spring retainer 76. This embodiment further reduces the height of the compact electromagnetic valve actuator by an amount equal to the portion of the valve spring encompassed by the upper spring.

Figure 1:
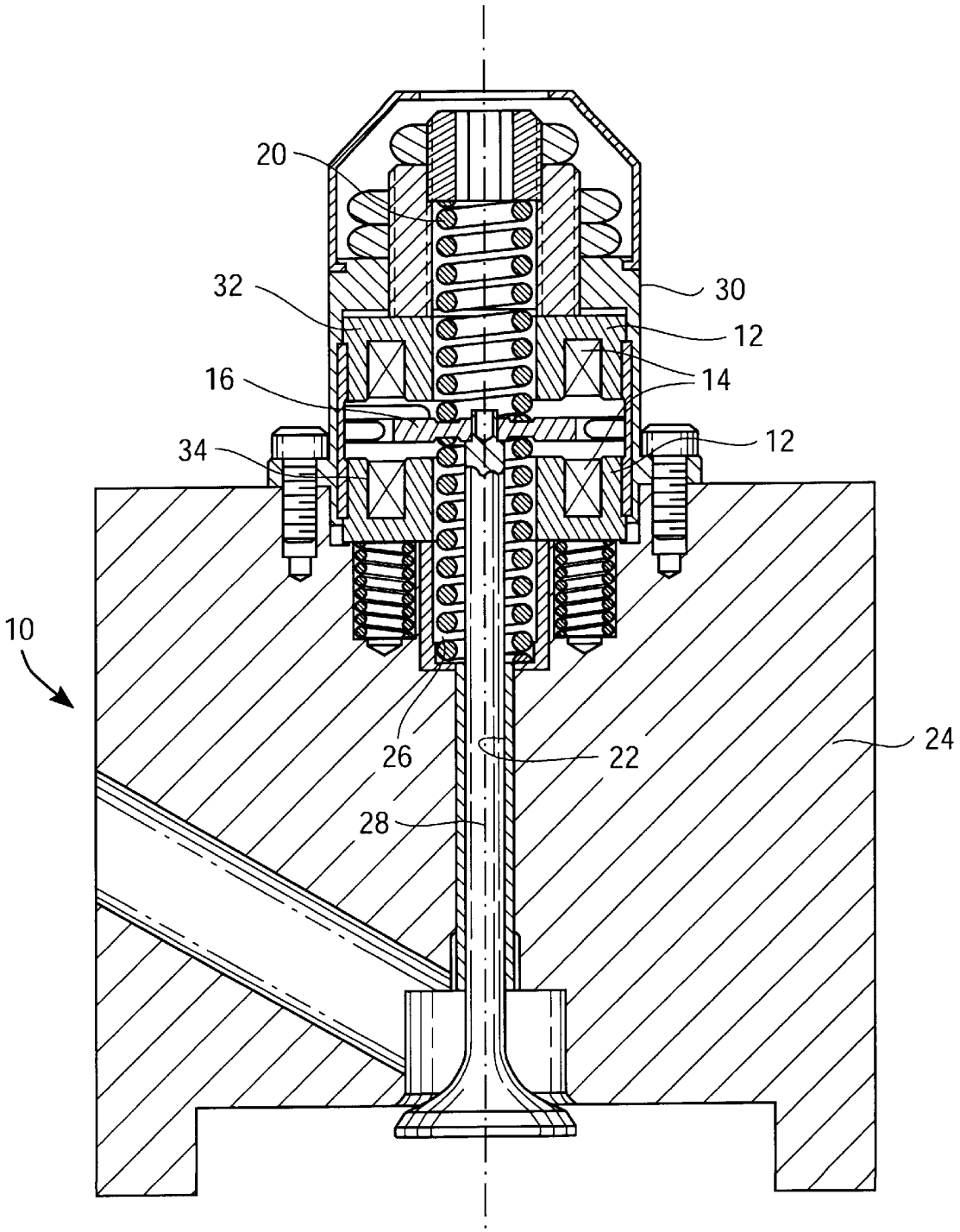
FIG. 1 (PRIOR ART)
FIG. 1 (PRIOR ART) is a cross-sectional view of a known electromagnetically actuated valve.

The arrangement of the armature shaft 58 and the valve stem 90 compensate for heat expansion in the valve stem. Generally, when the valve head 88 is properly seated, the armature element 56 should be in contact with the upper electromagnet 52. As shown in prior art FIG. 1, previous known actuators employ an armature shaft that is integrally attached to the valve stem. The problem with the prior art design is that when the temperature increases, the valve stem expands causing the armature element to contact the upper electromagnet before the valve head is properly seated. On the other hand, if the valve stem is shortened to accommodate for heat expansion, the valve head may seat before the armature contacts the upper electromagnet. The present invention resolves this problem by detaching the armature element from the valve stem and providing a lash therebetween.

When the lower electromagnet is energized and the valve is opened, the armature shaft contacts the tip of the valve stem and pushes the valve stem open. When the upper electromagnet is energized and the valve is closed, the armature shaft lifts up allowing the expansion of the compressed valve spring, which in turn lifts the valve stem upward. Once the valve head is seated, if there is still a gap between the armature element and the upper electromagnet, the armature shaft will separate from the valve stem and continue its motion until it contacts the upper electromagnet. This design allows for a clearance between the armature shaft and valve stem.

A lash cap 104 may be installed covering the valve stem tip 92. The lash cap 104 protects the valve stem tip 92 from erosion. As described above, during the opening of the valve, the armature shaft 58 strikes the tip 92 of the valve stem 90. The continuous hitting of the armature shaft 58 against the tip 92 of the valve stem could eventually lead to the wearing away of the valve stem 90. The installation of the lash cap 104 provides a layer of protection. Instead of striking the valve stem tip 92, the armature shaft 58 hits the lash cap 104. The use of a lash cap 104 prolongs the structural integrity of the valve stem 90.

Figure 4:
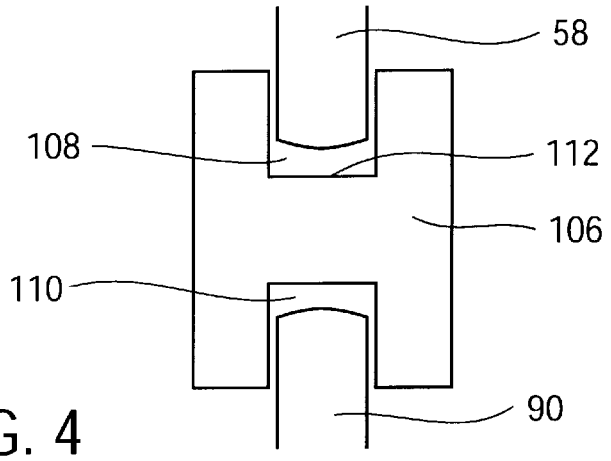
FIG. 4 is a cross-sectional view of an alternate embodiment of the present invention utilizing a hydraulic valve adjuster.

In FIG. 4, an alternative embodiment of the present invention is shown. In this embodiment, a hydraulic valve adjuster 106 is placed between the armature shaft 58 and the valve stem 90. The hydraulic valve adjuster 106 includes an upper chamber 108 and a lower chamber 110. The upper chamber 108 is dimensioned to receive the armature shaft 58. The lower chamber 110 is dimensioned to receive the valve stem 90. To minimize erosion of the armature shaft 58, the hydraulic valve adjuster is lubricated with a viscous liquid. As the valve opens, the armature shaft 58 lowers to the base 112 of the upper chamber 108. The viscous liquid retards the motion of the shaft and provides a softer landing for the armature shaft. The use of the hydraulic valve adjuster 106 reduces erosion of both the valve stem 90 and the armature shaft 58.

Figure 5:
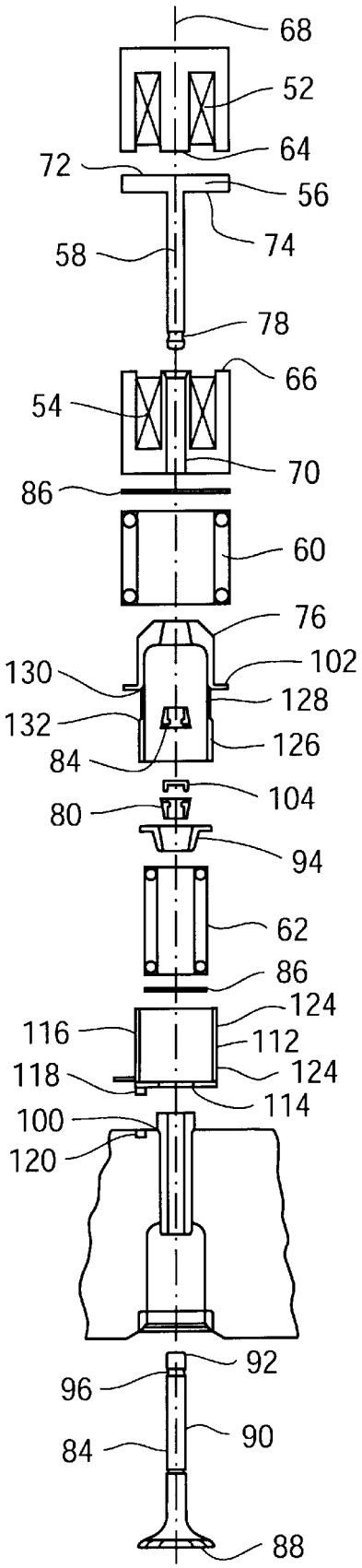
FIG. 5 is an exploded view of an embodiment of the present invention utilizing a valve or armature position sensor.
Figure 6:
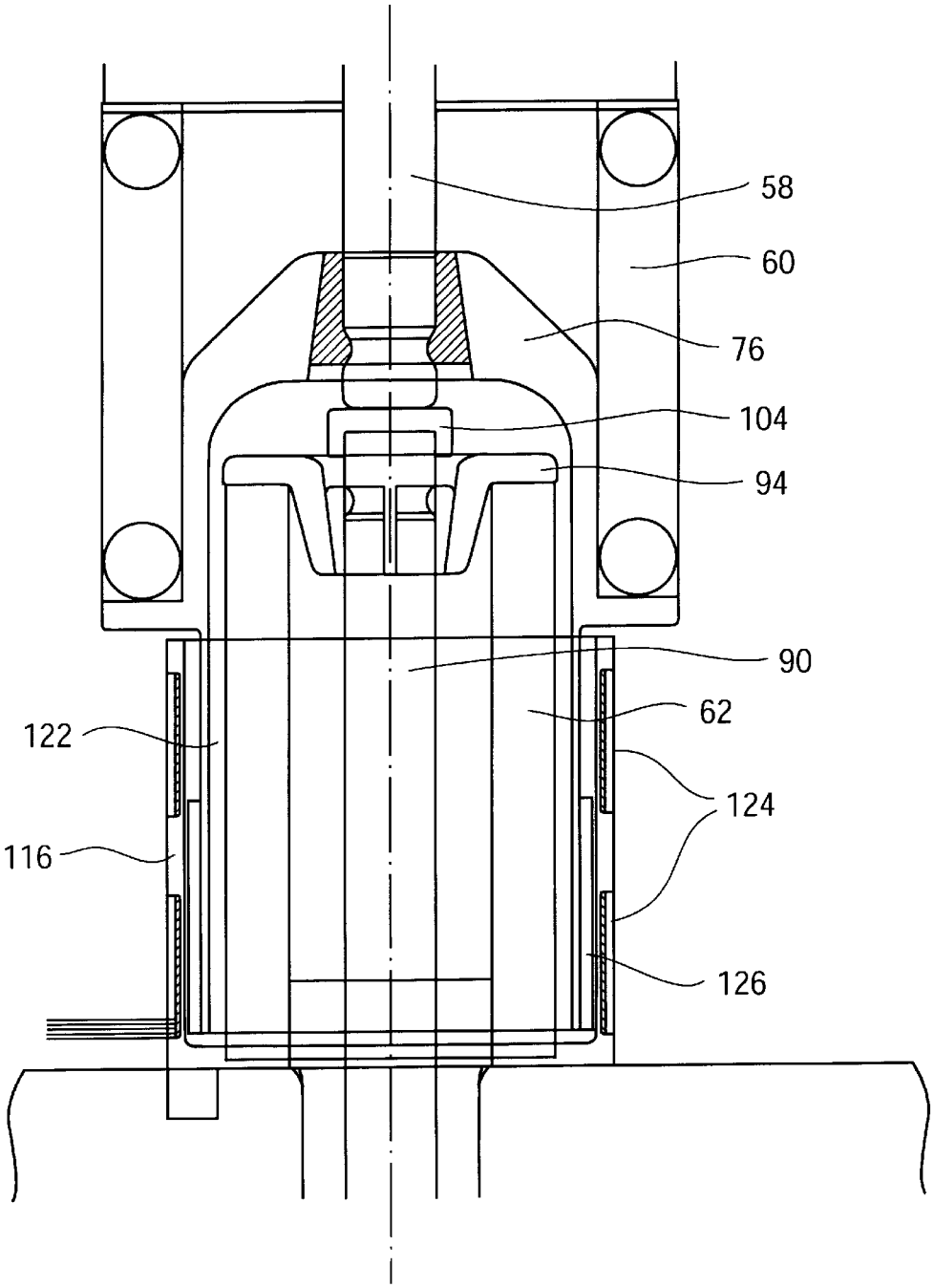
FIG. 6 is a cross-sectional view of the embodiment shown in FIG. 5.
Figure 7:
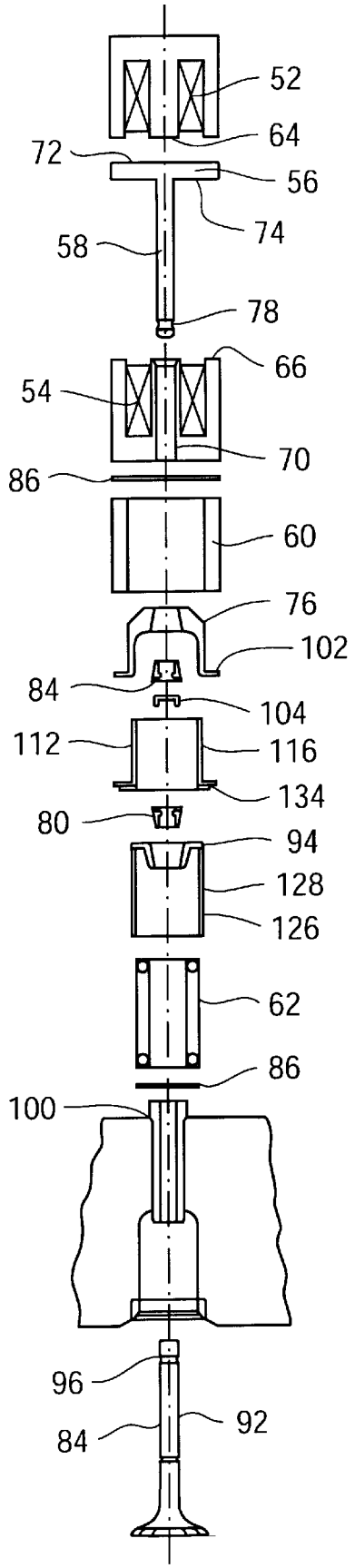
FIG. 7 is an exploded view of an alternate embodiment of the present invention.

As best shown in FIGS. 5, 6 and 7, a sensor can be incorporated into the actuator to detect the position of the valve. In FIG. 5, sensor 112 is shown. Sensor 112 is cylindrically shaped and comprises a base 114, sensor wall 116, and a projecting pin 118. The valve seat 100 defines a notch 120 dimensioned to receive the projecting pin 118. Sensor 112 is seated on the valve seat 100 such that base 114 rests against the cylinder head 98. The projecting pin 118 is fitted into the notch 120. The placement of the projecting pin 118 into the notch 120 prevents the undesired rotation or sliding of the sensor 112.

Valve spring 62 is disposed intermediate the sensor base 114 and the valve spring retainer 94. The seating pressure of the valve spring 62 situated between the valve spring retainer 94 and the sensor base 114, prevents the sensor 112 from moving. Valve spring 62 and sensor wall 116 are separated by a gap 122.

The sensor wall 116 includes two coils 124, placed in a spaced apart relationship to each other, wound about the same axis. A target 126 is placed inside the coils 124. As current changes in the coils, eddy currents are induced in the target 126 that oppose the change in flux. This reduction in flux change reduces the impedance of the coil allowing more current to flow. As the target 126 moves to one end of the sensor, the current in the closest coil increases while the current in the distant coil decreases. Accordingly, the sensor detects the position of the valve by monitoring the current flowing through these coils.

When a sensor is used, the upper spring retainer 76 is preferably constructed from a substantially nonconductive, lightweight material, such as titanium. Support member 128 is used to carry target 126. Support member 128 includes a first end 130 and a second end 132. The first end 130 of the support member 128 is integrally attached to the upper spring retainer 76. In the preferred embodiment, target 126 is a conductive ring, such as an aluminum ring, attached to the second end of the support member 128. Alternatively, target 126 can be a coating plated onto the second end of the support member 128.

FIG. 6 is a cross sectional view of the actuator showing the sensor 112 installed. The target 126 is disposed in gap 122 proximal the sensor wall 116. The target can be in slidable engagement with the sensor wall 116. Alternatively, the target 126 can be placed in a spaced apart relationship to the sensor wall 116 such that a small gap exists between the sensor coils 124 and the target 126.

FIG. 7 shows an alternative location for the target 126. In this embodiment the first end 130 of the support member 128 is integrally attached to the valve spring retainer 94. An alternative means of installing the sensor 112 is also shown in FIG. 7. In this embodiment, the sensor 112 has a cylindrical sensor wall 116 and an outer lip 134. The sensor 112 is installed such that the sensor wall 116 encompasses the target 126. The lip 134 of the sensor 112 rests on top of the cylinder head 98 and can be fastened thereto for security.

In yet another embodiment of the present invention, not shown, the sensor 112 can be integrated into the electromagnetic assembly. Specifically, the upper and lower electromagnet each have a receiving groove. A first field coil snaps into the groove of the upper electromagnet and a second field coil snaps into the groove of the lower electromagnet. The sensor coils serve as physical coil locks to the power coils of the electromagnets. The position of the sensor coils support the power coils and prevent undesired movement of those power coils.

There has been described hereinabove an exemplary preferred embodiment of the electromagnetic valve actuator according to the principles of the present invention. Those skilled in the art may now make numerous uses of, and departures from, the above-described embodiments without departing from the inventive concepts disclosed herein. Accordingly, the present invention is to be defined solely by the scope of the following claims.

I claim as my invention:

1. An electromagnetic actuator for an actuated valve mounted onto a cylinder head, the valve having a valve stem and a valve step tip, the actuator comprising:

at least one pair of electromagnets, each pair of electromagnets further comprising an upper electromagnet and a lower electromagnet, wherein the upper and lower electromagnets of said pair are in a mirror relationship to each other about a central vertical axis, said lower electromagnet further having a channel disposed therein;

an armature element disposed intermediate said upper and lower electromagnet, said armature element having a normally biased initial first position when said upper and lower electromagnets are off, a second fixed open position proximal said lower electromagnet when said lower electromagnet is energized, and a third fixed close position proximal said upper electromagnet when said upper electromagnet is energized;

an armature shaft integrally attached to said armature element and extending vertically through said channel of said lower electromagnet;

an tipper spring retainer assembled onto said armature shaft;

a support member having a first end and a second end, said first end of said support member integrally attached Lo said upper spring retainer;

a target disposed on said second end of said support member;

an upper spring disposed intermediate said upper spring retainer and said lower electromagnet;

a valve spring retainer mounted onto the valve stem;

a valve spring disposed intermediate said valve spring retainer and the cylinder head; and a sensor having a cylindrical wall, said cylindrical wall encompassing said valve spring and defining a gap to receive said target.

2. An electromagnetic actuator for an actuated valve in accordance with claim 1, wherein said sensor further comprises a base, said base being disposed on the cylinder head.

3. An electromagnetic actuator for an actuated valve in accordance with claim 2, wherein said sensor further comprises a projecting pin protruding from said base of said sensor, and further wherein the cylinder head defines a groove dimensioned to receive said projecting pin, said projecting pin inserted into said groove.

4. An electromagnetic actuator for an actuated valve mounted onto a cylinder head, the valve having a valve stem and a valve stem tip, the actuator comprising:

at least one pair of electromagnets, each pair of electromagnets further comprising an upper electromagnet and a lower electromagnet, wherein the upper and lower electromagnets of said pair are in a mirror relationship to each other about a central vertical axis, said lower electromagnet further having a channel disposed therein;

an armature element disposed intermediate said upper and lower electromagnet, said armature element having a normally biased initial first position when said upper and lower electromagnets are off, a second fixed open position proximal said lower electromagnet when said lower electromagnet is energized, and a third fixed close position proximal said upper electromagnetic when said upper electromagnet is energized;

an armature shaft integrally attached to said armature element and extending vertically through said channel of said lower electromagnet;

an upper spring retainer assembled onto said armature shaft;

an upper spring disposed intermediate said upper spring retainer and said lower electromagnet;

a valve spring retainer mounted onto the valve stem;

a support member having a first end and a second end, said first end of said support member integrally attached to said valve spring retainer;

a target disposed on said second end of said support member;

a valve spring disposed intermediate said valve spring retainer and the cylinder a sensor having a cylindrical wall, said cylindrical wall encompassing said valve spring and defining a gap to receive said target.

5. An electromagnetic actuator for an actuated valve in accordance with claim 4, wherein said sensor further comprises a protruding lip, said lip resting on the cylinder head.

6. An electromagnetic actuator for an actuated valve in accordance with claim 5, wherein said sensor lip is fastened onto the cylinder head.

* * * * *